US007422659B2

(12) United States Patent
Rheims et al.

(10) Patent No.: US 7,422,659 B2
(45) **Date of Patent: *Sep. 9, 2008**

(54) METHOD AND APPARATUS FOR TREATING A WEB OF PAPER OR BOARD

(75) Inventors: Joerg Rheims, Toenisvorst (DE); Ulrich Rothfuss, Grefrath (DE)

(73) Assignee: Voith Paper Patent GmbH, Heidenheim (DE)

( * ) Notice: Subject to any disclaimer, the term of this patent is extended or adjusted under 35 U.S.C. 154(b) by 465 days.

This patent is subject to a terminal disclaimer.

(21) Appl. No.: 11/122,955

(22) Filed: May 4, 2005

(65) Prior Publication Data

US 2005/0257906 A1 Nov. 24, 2005

(30) Foreign Application Priority Data

May 6, 2004 (DE) ..... 10 2004 022 416

(51) Int. Cl.

| | |
|---|---|
| ***D21H 25/06*** | (2006.01) |
| ***D21H 23/48*** | (2006.01) |
| ***D21H 19/00*** | (2006.01) |
| ***D21G 1/00*** | (2006.01) |
| ***D21F 11/00*** | (2006.01) |
| ***B05C 5/00*** | (2006.01) |

(52) U.S. Cl. ..... 162/136; 162/205; 162/265; 162/361; 118/117; 118/122; 118/DIG. 4; 427/361

(58) Field of Classification Search ..... 162/204–207, 162/358.3, 361, 135–137, 265; 100/156, 100/160; 118/116–119, 121–123, 126, DIG. 4; 427/361, 366, 359, 362, 365

See application file for complete search history.

(56) References Cited

U.S. PATENT DOCUMENTS

| | | | | |
|---|---|---|---|---|
| 6,063,449 | A | 5/2000 | Koskinen et al. | |
| 6,164,198 | A * | 12/2000 | Honkalampi et al. | 100/327 |
| 6,413,371 | B1 | 7/2002 | Ahonen et al. | |
| 6,890,407 | B1 * | 5/2005 | Koivukunnas et al. | 162/205 |
| 2005/0037158 | A1 * | 2/2005 | Hong | 428/32.34 |
| 2005/0098285 | A1 * | 5/2005 | Aust et al. | 162/136 |
| 2006/0118256 | A1 * | 6/2006 | Lares et al. | 162/135 |

FOREIGN PATENT DOCUMENTS

| | | |
|---|---|---|
| DE | 102 28 117 A1 | 1/2004 |
| EP | 1 249 533 A1 | 10/2002 |

(Continued)

OTHER PUBLICATIONS

EP Search Report, Sep. 1, 2005, for related application.

*Primary Examiner*—Eric Hug
(74) *Attorney, Agent, or Firm*—Taylor & Aust, P.C.

(57) ABSTRACT

A method and an arrangement for treating a web (2) of paper or board is described, in which a functional coating (5) is applied to the web (2) and the web (2) is then calendered.

It is wished to obtain a web provided with a functional coating in a cost-effective fashion.

This is achieved through the following combination:

the functional coating (5) is applied without direct contact, the web (2) is calendered online in conjunction with the application of the coating, calendering takes place in a broad nip (18) in a shoe calender (9), which exhibits a shoe roller (10) with a rotating outer cover (11) and a squeeze roller (14).

7 Claims, 1 Drawing Sheet

FOREIGN PATENT DOCUMENTS

| | | | |
|---|---|---|---|
| WO | WO 00/70144 | | 11/2000 |
| WO | WO 02/103109 | A1 | 12/2002 |
| WO | WO 03/050352 | A1 | 6/2003 |
| WO | WO 2004/001132 | * | 12/2003 |
| WO | WO 2004/048687 | A1 | 6/2004 |

* cited by examiner

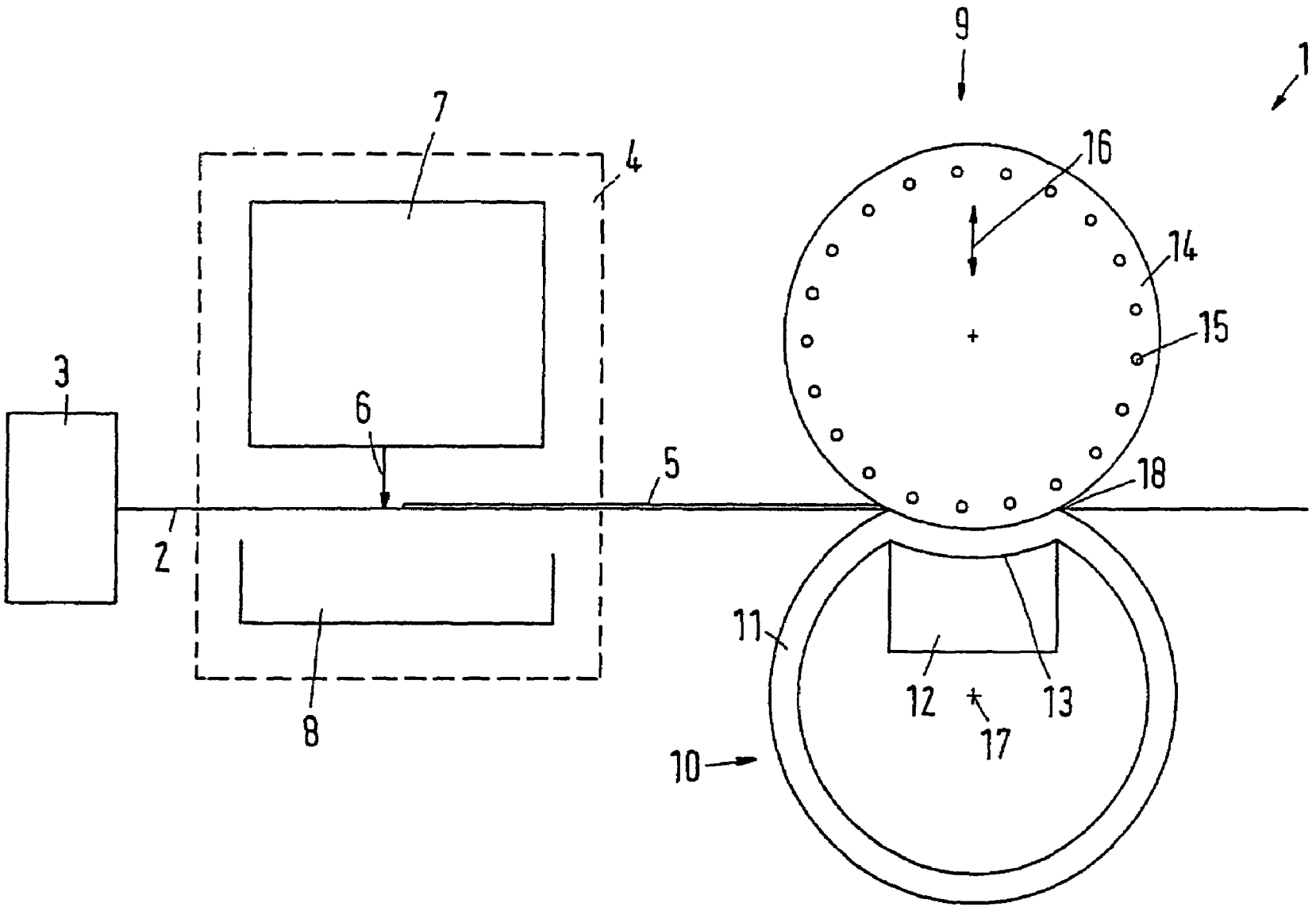
1
9
16
14
15
18
13
17
12
11
10
5
4
7
6
8
2
3

METHOD AND APPARATUS FOR TREATING A WEB OF PAPER OR BOARD

CROSS REFERENCE TO RELATED APPLICATIONS

The present application claims priority under 35 U.S.C. § 119 of German Patent Application No. 10 2004 022 416.1 filed on May 6, 2004, the disclosure of which is expressly incorporated by reference herein in their entireties.

BACKGROUND OF THE INVENTION

1. Field of the Invention

The invention relates to a method for treating a web of paper or board, in which a functional coating is applied to the web and the web is then calendered. The invention further relates to an apparatus for treating a web of paper or board with a coating device and a calender.

2. Discussion of Background Information

Webs of paper or board, for which the brief designation "web" is also used below, are frequently provided with a coating on at least one surface. This coating, which is in the form of a layer, can have different purposes. For example, the web can be glazed. An additional function can also be assigned to the coating, however. For example, the web can be made thermosensitive with the help of the coating. A thermosensitive web can be used, for example, in facsimile machines or other printers, which write on the web utilizing locally applied heat.

Functional coatings are relatively costly. The costs of webs that are provided with a functional coating are increased accordingly.

SUMMARY OF THE INVENTION

The instant invention is directed to produce webs with a functional coating at a reasonable cost. A reasonably cost web with a functional coating is achieved by a combination of the following:

- the functional coating is applied without direct contact,
- the web is calendered online in conjunction with the application of the coating, and
- calendering takes place in a broad nip in a shoe calender the shoe calender having a shoe roller with a rotating outer cover and a squeeze roller.

Surprisingly, the quantity of the functional coating required to meet specific requirements can be reduced considerably through this combination. When the functional coating is applied without direct contact, the layer thickness of the functional coating can be set to a minimum. The resulting layer then follows the contour of the surface of the web, i.e. there is no need to compensate for any roughness of the web and to fill in any "valleys". This type of coating application thus saves considerable costs, because less coating is required. After applying the coating, all areas of the web are uniformly covered with the functional coating to an adequate degree. Due to the fact that the web is not then calendered in a "normal" calender, in which two rollers interact, but rather in a shoe calender, which exhibits a relatively long nip in the direction of travel of the web, calendering takes place in which a predetermined degree of resistance to abrasion is imparted to the web. It is not necessary for the web to be calendered in respect of glazing or luster, even though certain advantageous effects appear as a consequence of this. The use of a broad nip permits the compressive stresses which act on the web to be kept so small that the "peaks", which are present due to the roughness of the web, do not penetrate through the layer produced by the functional coating. Even when the functional coating is used in a very thin layer, the web remains covered with coating over its complete surface, so that the calendering does not once again spoil the advantage previously achieved from the application of the coating without direct contact. The combination of application of the coating without direct contact and calendering in the broad nip thus results in a significant reduction in the quantity of material required for the functional coating. If calendering is now performed online in conjunction with the application of the coating, savings are achieved not only in relation to the operation, but also the web is calendered at a stage at which the functional coating has not yet reached its final strength. It is accordingly still possible, within certain limits, to undertake reforming at least on the surface of the functional coating without noticeably reducing the thickness of the layer formed by the functional coating.

A temperature of less than 60° C. is preferably maintained in the broad nip. The shoe calender is thus operated "cold". This is unusual, because shoe calendars are basically always operated at relatively high temperatures. It has been found, however, that calendering of the web is sufficient to achieve the desired characteristics at relatively low temperatures, which can even lie well below 60° C., for example 40° C. or even 30° C. In particular, adequate resistance to abrasion is imparted to the web.

A line load not exceeding 600 N/mm is preferably set for a length of the broad nip of at least 40 mm. This is sufficient to reduce the roughness of the web to a desired value. On the other hand, the volume is not noticeably reduced at this low value of the line load.

The outer cover of the shoe roller of the shoe calender is preferably held stationary, and the squeeze roller is lowered into the outer cover. This has the advantage that no extension of the outer cover takes place, and consequently also no flexing action. There is accordingly also no overheating in the areas of the lateral peripheral zones, and the outer cover is less highly stressed. The costs are reduced accordingly.

A Curtain Coater is preferably used to apply the coating. The use of a Curtain Coater permits the coating to be applied without direct contact and at a relatively low thickness.

The web is passed through the broad nip preferably at a speed in the range from 900 to 1,300 m/min. The best calendering result is achieved at this speed.

It is also advantageous if a compressive stress is selected in the broad nip, at which the thickness of the web is reduced by a maximum of 2.5%. Volume-conserving calendering can be achieved in this manner.

The object is achieved in an arrangement of the kind described by way of introduction through the following combination:

- the coating device is executed as a coating device operating without direct contact,
- the calender is arranged online with the coating device, and
- the calender is executed as a shoe calender with a shoe roller exhibiting a rotating outer cover and a squeeze roller interacting with the shoe roller.

As described above in conjunction with the method, this combination permits the advantage to be achieved that the application of the coating can be kept exceptionally thin, but without the coating being damaged again locally by the subsequent calendering. A web is obtained at the outlet from the broad nip that is uniformly coated with the functional coating, but without, for example, the "peaks" in the roughness of the "rough" web having been caused to penetrate through the layer of the functional coating.

The squeeze roller preferably exhibits a surface temperature of less than 60° C. The shoe calender is therefore operated cold. This has not, in principle, previously been expected to produce a particularly good effect. An adequate calendering effect, and in particular outstanding resistance to abrasion, are achieved in conjunction with a functional coating, however.

The shoe calender preferably exhibits a broad nip with a length of at least 40 mm, in which a line load not exceeding 600 N/mm is present. Only small compressive stresses are produced as a result. These compressive stresses are sufficient, however, to impart the necessary resistance to abrasion to the web.

It is also advantageous if the shoe roller exhibits a stationary shoe, and if the squeeze roller is capable of being lowered into the outer cover. In this case, peripheral extensions are avoided at the end faces of the outer cover of the shoe roller. The flexing action that occurs in the outer cover of the shoe roller remains lower. Problems with overheating in the peripheral zones are avoided in this way. Stressing of the outer cover is kept small. The overall service life of the outer cover can be increased in this way. The costs are reduced.

The coating device is preferably executed as a Curtain Coater. A particularly thin application of the coating can be achieved with a Curtain Coater.

BRIEF DESCRIPTION OF THE DRAWINGS

The present invention if further described in the detailed description which follows, in reference to the noted drawing by way of non-limiting example of exemplary embodiment of the present invention, and wherein:

The Figure illustrates a plan view of a schematic representing the apparatus for calendering and treating a paper web according to the invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The figure shows an arrangement 1 for treating a web 2 of paper or board. The web 2 comes from a paper or board machine 3 that is represented only schematically here. Additionally, the web 2 can also be unwound from a roll, for example a jumbo roll, not shown.

The web 2 passes through a coating device 4, in which a functional coating 5 is applied to one surface. The coating device 4 is depicted here as a "Curtain Coater", which allows coating color in the form of a curtain 6 (symbolized by an arrow) to run onto the web 2. By matching the quantity dispensed to the speed of the web 2, an exceptionally thin coating can be applied to the surface of the web 2. For reasons of clarity, the coating 5 is represented with an exaggerated thickness in the drawing.

The functional coating 5 may be a thermosensitive coating, for example, so that the web 2 ultimately becomes a thermosensitive paper or a thermosensitive board. In addition to a binding agent and a number of secondary components, the coating 5 in this case usually contains two color precursors, which, when they are caused to enter into a reaction with one another by melting, produce a mainly black color. The main areas of application include facsimile papers and papers for printers, plotters and labels. The thermo-reactive coating can be supported by a thermally insulating precoating, not shown, which can also be applied with a Curtain Coater.

The coating device has a dispensing device 7 for applying the coating 5, also known as a "coating color", to the web 2, and a collecting vessel 8, in which any laterally overshooting coating color can be collected. The coating color can be returned from the collecting vessel 8 to the dispensing device 7 by a means not illustrated in the figure.

Arranged online in relation to the coating device 4 is a shoe calender 9, which has a shoe roller 10 with a revolving outer cover 11 and a supporting shoe 12. The supporting shoe 12 has a pressure surface 13, which is provided with devices for the purpose of introducing lubricants, for example hydraulic oil, not shown. A squeeze roller 14 interacts with the outer cover 11 of the shoe roller 10, the squeeze roller having a plurality of peripheral bores 15 to enable the temperature at the surface of the squeeze roller 14 to be adjusted. As indicated by a double arrow 16, the squeeze roller 14 is capable of being displaced in relation to the shoe roller 10. The supporting shoe 12 of the shoe roller 10 is arranged in a stationary fashion. The squeeze roller 14 is thus lowered into the outer cover 11 of the shoe roller 10. This has the advantage that the outer cover 11 does not need to be extended at its axial ends. It is usually equipped at that point with end discs, which rotate about an axis 17.

The shoe roller 10 and the squeeze roller 14 together form a broad nip 18, in which the web 2 with the functional coating 5 applied to it, is calendered. The temperature in the broad nip 18 is now set to a relatively low value. The maximum surface temperature of the squeeze roller 14 is 60° C. In order to achieve this, it may be necessary to cause a relatively colder medium to flow through the peripheral bores 15, thereby cooling the squeeze roller 14. This will depend on how hot the web 2 is, and on the increase in temperature that results from the processing of the web 2 in the broad nip 18. The temperature of the squeeze roller 14 will preferably be set to an even lower value, for example, at 40° C. or only 30° C.

The broad nip 18 has a length of at least 40 mm in the direction of travel of the web 2. A greater length is preferable, and can be up to 400 mm. A line load of 600 N/mm, for example, is generated in the broad nip, so that a compressive stress of about 15 $N/mm^2$ results for a nip length of 40 mm. The compressive stress should be selected so that the volume of the web 2 in the broad nip 18 does not decrease significantly and is thus reduced by only 2.5%, for example.

The web 2 passes through the broad nip 18 at a speed in the range from 900 to 1,300 m/min. The situation is achieved, together with the low temperature and the relatively small compressive stress, in which the functional coating 5 is attached to an adequate degree to ensure that the web 2 possesses good resistance to abrasion. The resulting glazing and luster values of the web 2 also increase slightly.

An exceptionally thin layer thickness of the coating 5 is obtained with the arrangement described here, with the result that it is possible to manage with a relatively small amount of the expensive coating color. In spite of this thin coating thickness, two-dimensional coverage of the web 2 is also obtained if the web 2 is calendered in the broad nip 18 and the coated side lies against the squeeze roller 14, which exhibits a hard and smooth surface. The outer cover 11, on the other hand, is softer, and therefore is capable of plastic deformation.

It is advantageous if the pressure surface 13 is made in such a way that it follows the contour of the peripheral surface of the squeeze roller 14, also taking account of the thickness of the outer cover 11. This is not absolutely essential, however.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A method for treating a web, comprising the steps of: first applying a functional coating without direct contact between a coating supplier and the web; calendaring the web utilizing a broad nip in a shoe calendar, the shoe calendar having a shoe roller with a rotating outer cover and a squeeze roller, and wherein the functional coating is a thermosensitive coating.

2. The method of claim 1, wherein a temperature of less than 60 degree C. is maintained in the broad nip.

3. The method of claim 1, wherein a line load not exceeding 600 N/mm is set for a length of the broad nip of at least 40 mm.

4. The method of claim 1, wherein the outer cover of the shoe roller of the shoe calendar is stationary, and the squeeze roller is lowered into the outer cover.

5. The method of claim 1, wherein a curtain coater applies the coating.

6. The method of claim 1, wherein the web is passed through the broad nip at a speed in the range from 900 to 1,300 m/min.

7. A method for treating a web, comprising the steps of: first applying a functional coating without direct contact between a coating supplier and the web; calendaring the web utilizing a broad nip in a shoe calendar, the shoe calendar having a shoe roller with a rotating outer cover and a squeeze roller, wherein a compressive stress is selected in the broad nip, at which the thickness of the web is reduced by a maximum of 2.5%.

* * * * *

UNITED STATES PATENT AND TRADEMARK OFFICE

CERTIFICATE OF CORRECTION

PATENT NO. : 7,422,659 B2
APPLICATION NO. : 11/122955
DATED : September 9, 2008
INVENTOR(S) : Rheims et al.

It is certified that error appears in the above-identified patent and that said Letters Patent is hereby corrected as shown below:

TITLE PAGE:
-- Please add the following references under "FOREIGN PATENT DOCUMENTS"
--WO02/103109-- 12/2002; Korhonen, et al.
--WO00/70144-- 11/2000; Rautiainen, et al.
--WO03/050352-- 2003; Lares, et al.

Signed and Sealed this

Ninth Day of March, 2010

David J. Kappos

David J. Kappos
*Director of the United States Patent and Trademark Office*